United States Patent [19]

Abe

[11] Patent Number: 4,600,399

[45] Date of Patent: Jul. 15, 1986

[54] SEQUENTIAL ACTION TOY HAVING A PLURALITY OF CAMS

[75] Inventor: Akira Abe, Tokyo, Japan

[73] Assignee: Tomy Kokyo, Co. Inc., Tokyo, Japan

[21] Appl. No.: 546,958

[22] Filed: Oct. 31, 1983

[30] Foreign Application Priority Data

Nov. 4, 1982 [JP] Japan ..... 57-167090[U]

[51] Int. Cl.[4] ..... A63H 1/24

[52] U.S. Cl. ..... 446/242; 446/227; 446/243; 446/397; 40/414

[58] Field of Search ..... 446/227, 241, 246, 270, 446/330, 243, 352, 354, 358, 397, 404, 408, 484, 491, 236, 237, 238, 357, 303, 272, 280, 281, 242; 74/55; 40/414, 423

[56] References Cited

U.S. PATENT DOCUMENTS 3,359,680 12/1967 Lindsay ..... 446/272 X
3,919,795 11/1975 Jinivisian et al. ..... 446/227 X
4,282,680 8/1981 Zaruba ..... 446/270

FOREIGN PATENT DOCUMENTS 352221 3/1961 Switzerland ..... 446/303

*Primary Examiner*—Mickey Yu

*Attorney, Agent, or Firm*—K. H. Boswell

[57] ABSTRACT

A sequential action toy has a housing with a motor located in the housing. A disc is connected to the motor with the motor rotating the disc within the housing. The disc has a first and second cam surface located on it with the first cam surface extending axially a greater distance away from the surface of the disc than the second cam surface. A first movable member is mounted on the housing in association with the disc and includes a cam follower located thereon which is capable of being engaged by both the first and the second cams as the disc is rotated by the motor. Engagement of the cam follower on the first movable member moves the first movable member on the housing. A second movable member is also associated with the disc and includes a cam follower located thereon, except the cam follower on the second movable member is only capable of engaging the second cam on the disc with the second movable member then moving in response to engagement by the second cam as the disc is rotated. The housing further includes a sound mechanism located therein. The sound mechanism includes a CPU and a selection switch. The CPU electronically generates an assortment of musical selections depending upon the position of the selection switch.

20 Claims, 11 Drawing Figures

MOTOR

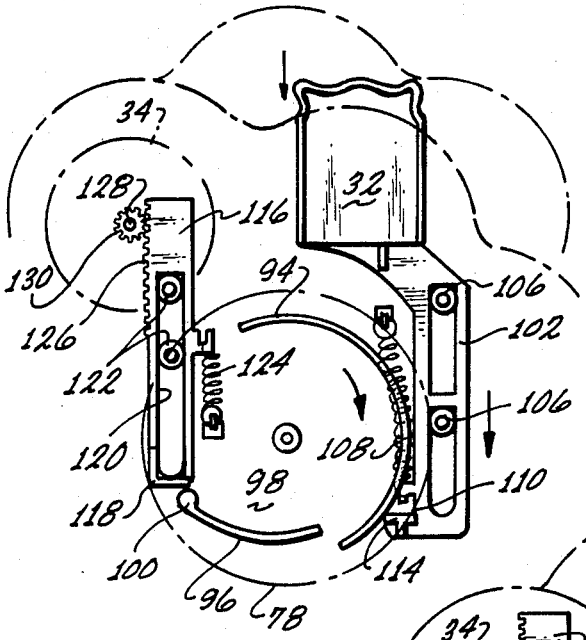
FIG. 6
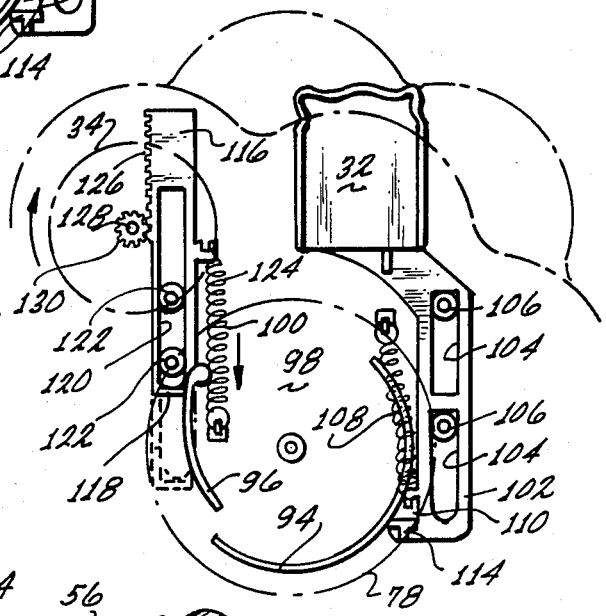
FIG. 7
FIG. 10
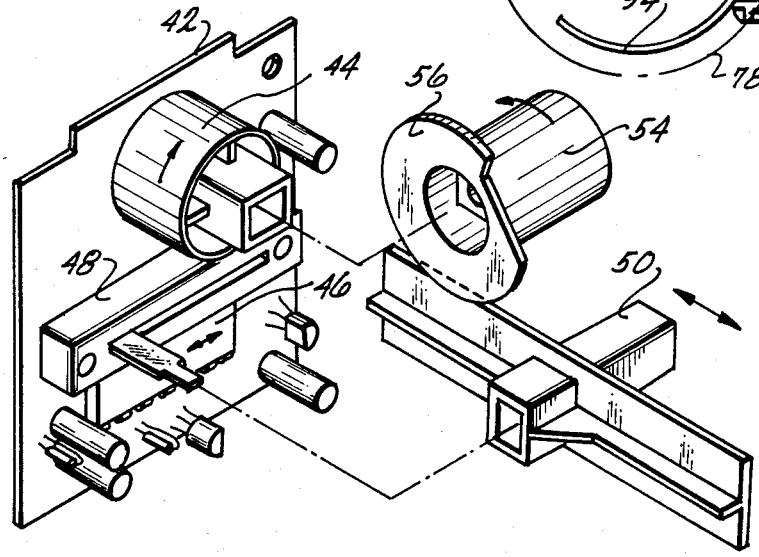

SEQUENTIAL ACTION TOY HAVING A PLURALITY OF CAMS

BACKGROUND OF THE INVENTION

This invention is directed to a sequential action toy wherein a plurality of movable parts of the toy are sequentially activated by cams located on rotating surfaces.

The subject matter of this invention is useful in toys of the type which can be attached to a baby's crib or the like in order to provide for entertainment of the occupant therein and for training of the infant's senses with regard to movable objects and sounds associated with them. It is known to combine music producing mechanisms with other mechanisms for creating motion of component parts accompanied by sound. Such devices are found in music boxes, per se, tops, and "activity type" toys. This latter category of toys would include such items as simulated musical instruments, instruments which require movement of a portion of the toy to produce sound output and the like.

In the past, the mechanical movements of the above noted toys was normally coupled directly to the musical movements. Many of the prior musical toys utilized drums and the like having a plurality of pegs thereon which interacted with tines of a sound producing mechanism as the drum rotated. This limited the musical sounds which could be produced to a single melody.

With the advent of modern sophisticated electronics, it is now possible to utilize relatively inexpensive microprocessors which can be programmed for reproducing musical selections. The sounds are produced electronically by coupling the microprocessor to an appropriate circuit adapted to drive a loud speaker. With the decoupling of the musical portion of these type of toys from the mechanical action portion, greater degress of latitude are available for producing mechanical movement.

Certain toys are known, such as that described in U.S. Pat. No. 3,498,603, which utilize a variety of cam surfaces which are radially displaced from a center of rotation. A member which is free to spin follows these cam surfaces and alternately spins in one direction and then the other as it moves from one cam surface to the next. It is important to note, however, that the member engages all of the cam surfaces in moving in a circular manner across the surface of the disc on which the cam surfaces are located.

A further type structure is disclosed in U.S. Pat. No. 3,279,793. In this patent a continuous cam surface has a plurality of undulations located on it in a circular pathway. A plurality of members follow this continuous cam surface and move upwardly and downwardly as they move over the undulations in the cam surface. As per the patent discussed in the previous paragraph, all of the members respond to each and every undulation in the cam surface.

Both of the mechanisms disclosed above have a very rhythmical mechanical output. It is deemed that as far as the interest of a small child is concerned, that a mechanical output which was less rhythmical but of sequential output, would provide for a greater attention keeping device as well as provide for movements which stimulate the development of basic sensory responses in the infant.

BRIEF DESCRIPTION OF THE INVENTION

In view of the above, it is a broad object of this invention to provide a device which produces a mechanical output which is sequential in action such that it is capable of maintaining the attention of a small child as well as providing for simulating output to develop the child's sensory capacity. It is a further object of this invention to provide such a device which is simple in its operation and construction such that little or no consideration need be given to operation of the same. It is a further object of this invention to provide such a device which, because of its engineering and manufacturing principles is economically available to the consuming public yet is capable of a long and useful lifetime.

These and other objects, as will become evident from the remainder of this specification, are achieved in a sequential action toy which comprises: a housing; motor means located on said housing; a first cam means rotatably mounted on said housing in operative association with said motor means and rotated about an axis by said motor means; said first cam means having a surface which is oriented perpendicular to said axis; said first cam means including first and second cams located thereon and extending axially from said surface, the axial displacement of said second cam from said surface greater than the axial displacement of said first cam from said surface; a first movable member movably mounted on said housing in association with said first cam means, said first movable member including a first cam follower located thereon, said first cam follower positioned in association with said first cam means axially displaced from said surface in a location whereby said first cam follower is independently engageable by both said first and said second cams in response to rotation of said first cam means so as to move said first member on said housing; a second movable member movably mounted on said housing in association with said first cam means, said second movable member including a second cam follower located thereon, said second cam follower positioned in association with said first cam means axially displaced from said surface in a location whereby said second cam follower is engaged by said second cam in response to rotation of said first cam means so as to move said second member on said housing.

The invention can further include an embodiment having a portion of both the first and second cams radially displaced a specific distance from the axis of rotation of the first cam member with the first and second cam followers being radially displaced at this same distance so as to be contacted by the first and second cams as the first cam member rotates. Further, the first and second movable members can be slidably mounted in association with the first cam means so as to move linearly along a pathway which lies tangential to the locus of movement of the first and second cams.

In the preferred embodiment of the invention, the first and second movable members would be on opposite sides of the first cam means with the cam followers located thereon, moving opposite to one another upon being engaged by a cam located on the first cam means.

Additionally, further cams can be incorporated in the toy. These further cams can include an eccentrically mounted cam which rotates in conjunction with the first cam means with a bifurcated member contacting this eccentrically located cam so as to be moved by the eccentrically located cam. Preferredly, the bifurcated member has its arms individually pivotally mounted to a third movable member with a spring urging the arms together so as to abut against the eccentrically rotating cam.

A pivoting member can additionally be associated with the first cam member with the pivoting member sized and shaped so as to overlay a portion of the first cam member in a first orientation and a further portion of the first cam member in a second orientation. In response to rotation of the first cam means, the pivoting member would pivot between its first and second orientations.

BRIEF DESCRIPTION OF THE DRAWINGS

This invention will be better understood when taken in conjunction with the drawings wherein:

FIG. 6 is a view similar to FIG. 5 except certain of the components are in a different spatial relationship than as seen in FIG. 5;

FIG. 7 is a view similar to FIGS. 5 and 6 except that certain of the components are shown in an even further spatial relationship;

FIG. 10 is an isometric exploded view of the music producing portion of the toy of FIG. 1.

Figure 1:
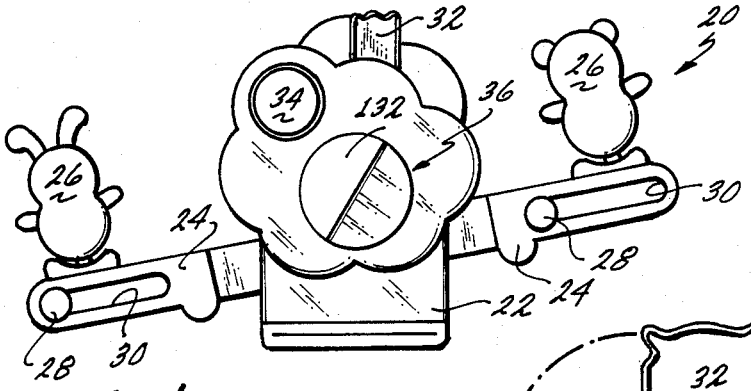
FIG. 1 is an elevational view of the front of a toy which embodies the principles of this invention.
Figure 5:
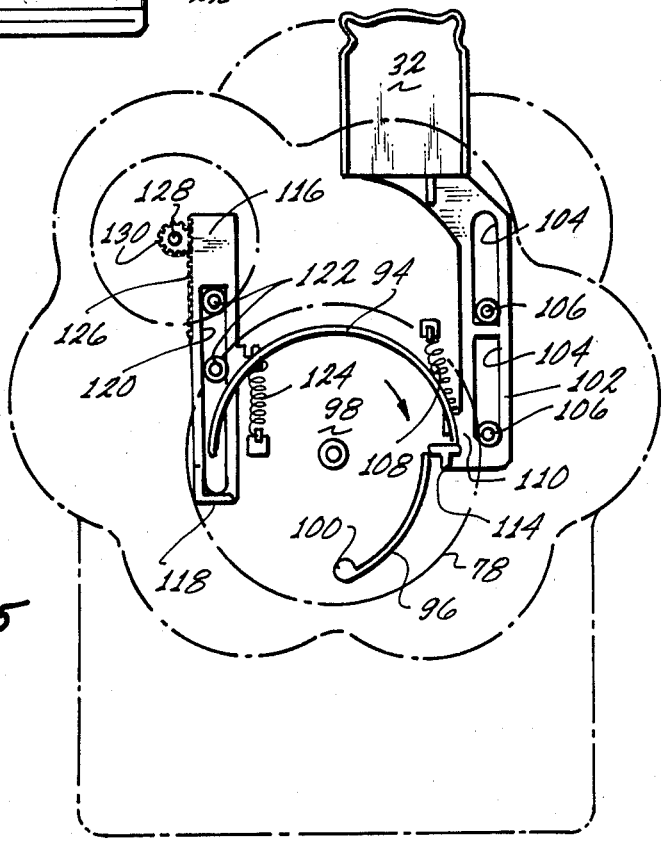
FIG. 5 is a elevational view showing certain of the components of FIG. 2 in phantom line and certain of the working components shown in solid line in a first spatial configuration.

The invention described in this specification and shown in the drawings utilizes certain principles and/or concepts as are set forth in the claims appended to this specification. Those skilled in the toy arts will realize that these principles and/or concepts are capable of being utilized with a variety of embodiments. For this reason, this invention is not to be construed as being limited to only the illustrative embodiment herein, but is only to be construed as being limited by the claims.

DETAILED DESCRIPTION OF THE INVENTION

In FIG. 1 there is shown a toy 20 having certain component parts. They include a housing 22 which is adapted on its rear side (not separately numbered or shown) such that it can be conveniently attached to a crib or the like (not separately numbered or shown). Projecting out of the housing on both the left and right hand sides is an arm 24.

Located at the respective ends of the arm 24 are figurines collectively identified by the numeral 26. The figurines are attached to the arm 24 such that they pivot slightly back and forth. Insofar as the mechanism for attaching the figurines allowing them to pivot is conventional in nature, a detailed description of the same is not given herein. Located directly below the figurines 26 are rolling discs 28 having oversized back and front surfaces such that they will be retained within slots 30. The discs 28 roll in the slots 30 as the respective arm ends of the arm 24 move upwardly and downwardly in response to movement of the arm 24 as hereinafter explained.

A pop up Figure 32 is located near the top of the toy 20 and is caused to move upward and downward exposing it and then hiding it within the housing 22 as hereinafter explained. To the left of the pop up figure 32 is a spinning indicia member 34. This member 34 contains an appropriate indicia located on its surface and the member 34 can spin both clockwise and counterclockwise as hereinafter explained.

Below the pop up Figure 32 in the center of the housing 22 is a flip over indicia component 36 which carries a member hereinafter identified, which is semicircular in construction and is located within the toy 20 so as to pivot, exposing first one side of the semicircular member and alternately the other side.

Figure 2:
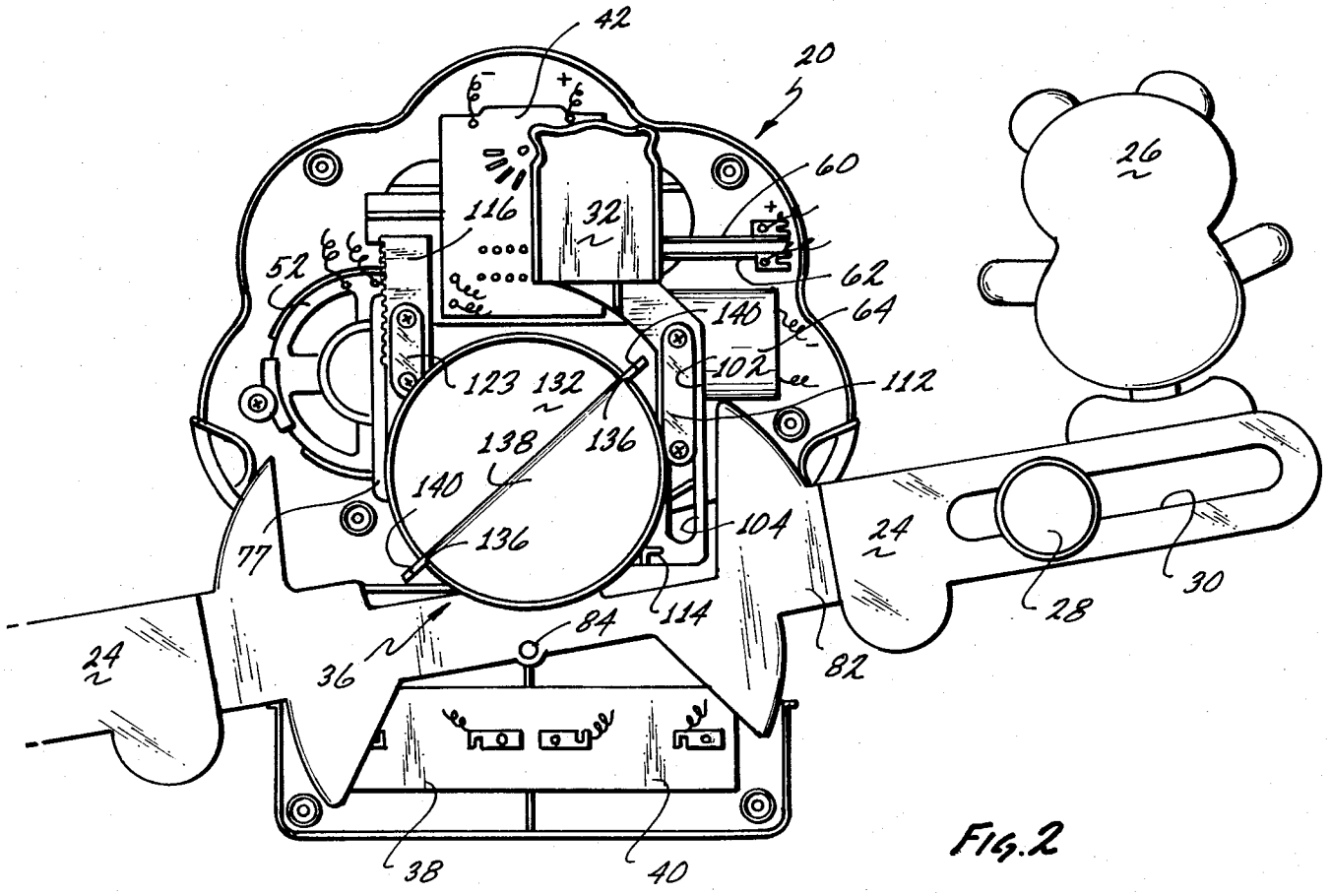
FIG. 2 is an elevational view similar to FIG. 1 except that an overlaying component has been removed to show underlying components located beneath it.

Referring now to FIG. 2, the toy 20 has a first and second battery compartment 38 and 40 in its base. Appropriate dry cells (not separately identified or shown) are located in the battery compartments 38 and 40. A printed circuit board 42 shown on its reverse side in FIG. 10 carries a switch member 44 which is appropriately connected to leads leading from battery compartment 38. The switch member 44 controls the opening and closing of the circuit which is printed on the printed circuit board 42.

The printed circuit board 42 further includes a microprocessor 46 such as a Sharp LR 3461122YBN which is programmed to include a plurality of musical selections which are selected utilizing selection switch 48. A slide button 50 mates with the selection switch 48 to allow for selection of the desired musical selection. The circuit board 42 includes other electrical components (not separately numbered or identified) which are utilized in conjunction with the microprocessor 46 to drive loudspeaker 52.

An off/on button 54 mates with the switch member 44 to control the same. Furthermore, refering to FIG. 11, the off/on button 54 includes a flange 56 having a notch therein which accepts one end of a pivoting arm 58.

Figure 11:
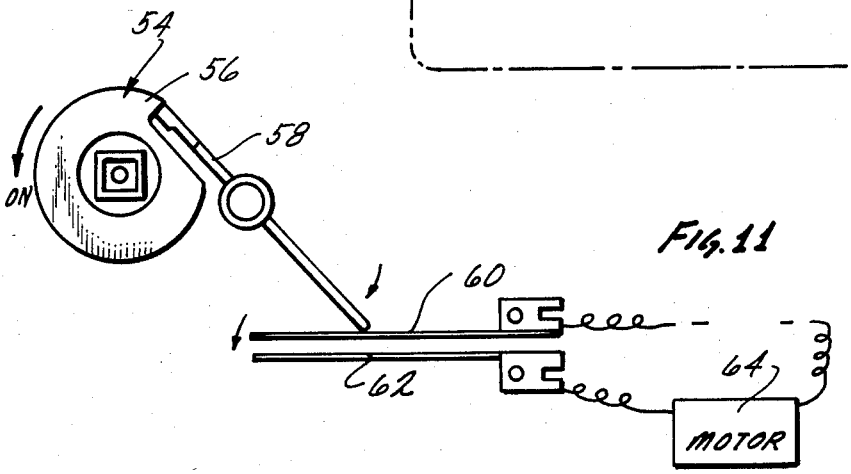
FIG. 11 is an elevational view of a switching mechanism for the mechanical portion of the toy of FIG. 1.

In FIG. 11, the off/on button 54 is on the "off" position and when it is rotated counterclockwise to the "on" position, the flange 56 abuts against the pivoting arm 58 rotating it clockwise such that the arm 58 bends contact 60 downwardly until it engages contact 62 to complete an electrical circuit through a motor 64 and the battery located in the other battery compartment 40. Thus, the off/on switch 54 controls both the musical circuit and the mechanical circuit, yet other than switch 44 each of these circuits is electronically and mechanically isolated from the other.

Figure 3:
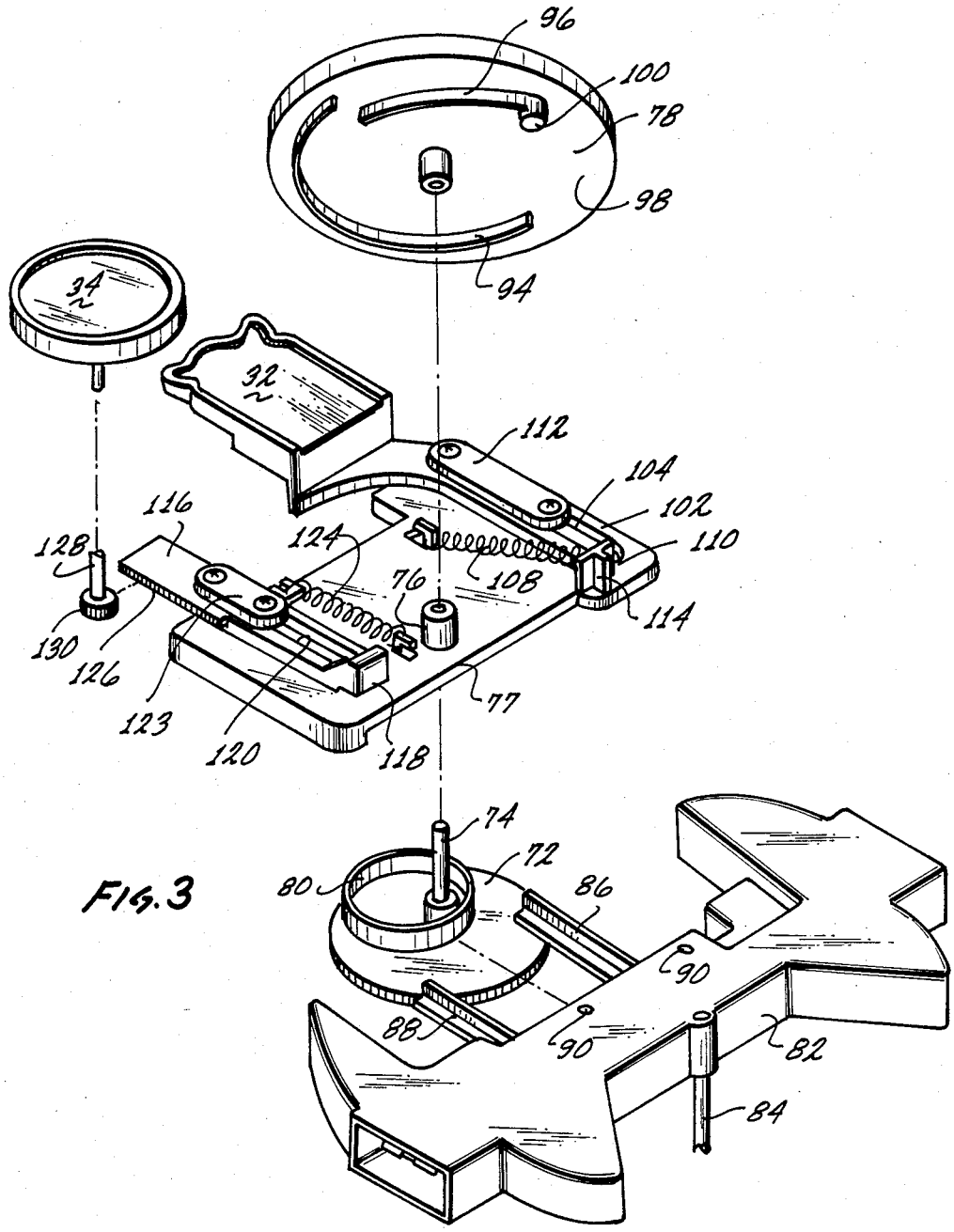
FIG. 3 is an exploded isometric view of certain of the working components seen in FIG. 2.
Figures 4, 8, 9:
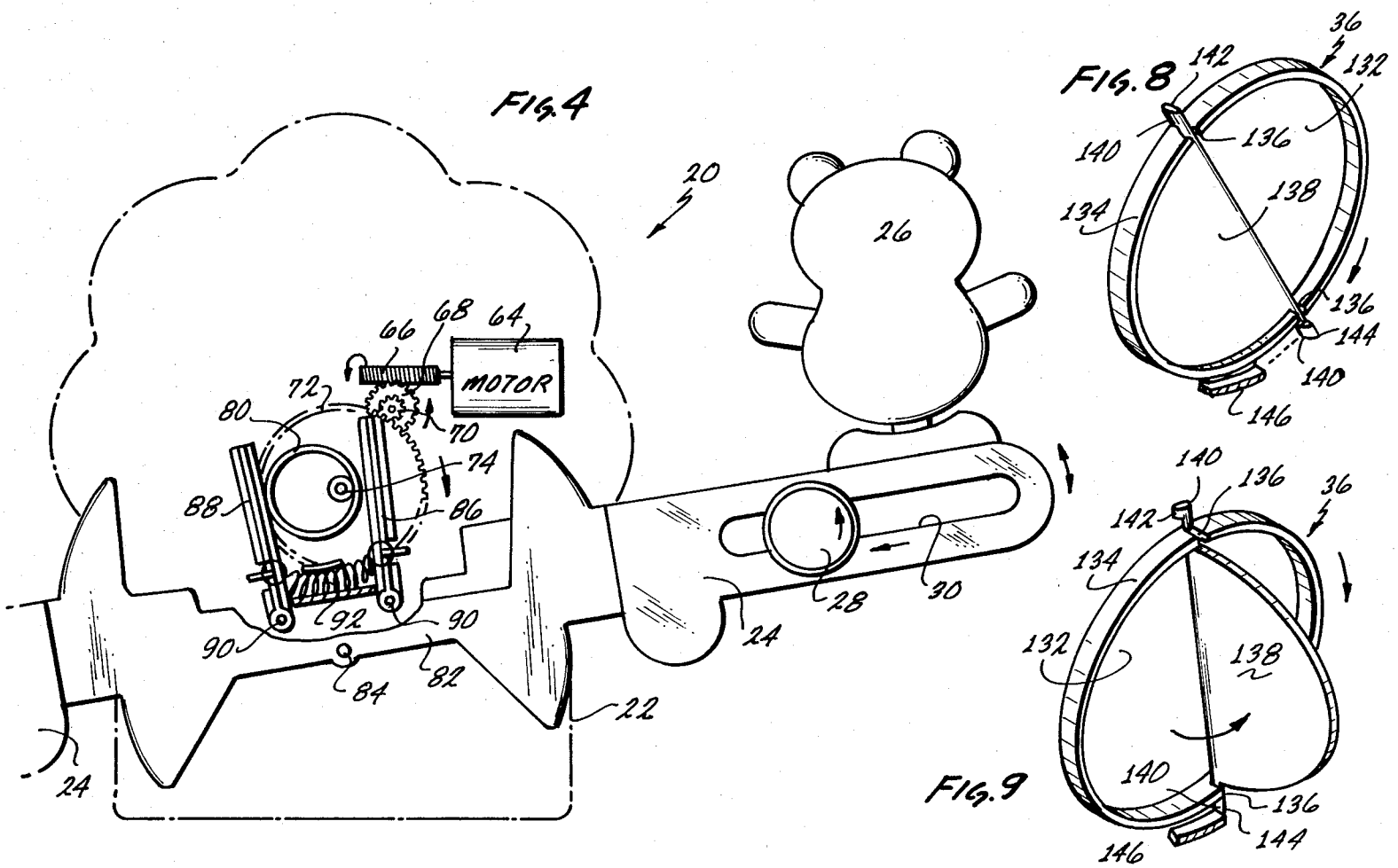
FIG. 4 is a view similar to FIG. 2 except additional overlaying components have been removed to clearly show other components lying beneath them.
FIG. 8 is an isometric view of certain of the components noted in the foreground of FIG. 2 in a first spatial configuration.
FIG. 9 is a view similar to FIG. 8 except certain of the components are noted in a further spatial configuration.

Referring now to FIG. 4, the motor 64 has a worm gear 66 on its output shaft. The worm gear 66 mates with a spur gear 68 which has a pinion 70 formed as a part thereof. The pinion 70 engages with a large gear 72 and rotates the same in response to rotation of the worm gear 66. This large gear 72 is fixed to an axle 74. The axle 74 extends through a bearing 76 formed on plate 77 as seen in FIG. 3. Plate 77 attaches to the inside of housing 22 in a conventional manner. A disc 78 is also fixedly mounted to the axle 74 on the opposite side of bearing 76 from the large gear 72. Thus, in response to rotation of the worm gear 66 both the large gear 72 and disc 78 are caused to rotate.

Referring to FIGS. 3 and 4, located on the surface of large gear 72 is an eccentric cam 80. A pivoting member 82 which is, in essence, the center part of arm 24, is pivoted about an axle 84 directly below the large gear 72. The pivoting member 82 has two arms, arms 86 and 88, pivotally mounted to it about axles collectively identified by the numeral 90. A spring 92 connects between the two arms 86 and 88 and biases them toward each other and toward cam 80. This positions the arms 86 and 88 along the outer surfaces of the eccentric cam 80.

As the large gear 72 is rotated, the eccentric cam 80 moves in an eccentric motion about the axle 74. It will contact one or the other of the arms 86 and 88 as it rotates and appropriately moves the arms 86 and 88 upon contact. Because of the presence of the spring 92, the arms 86 and 88 are essentially bifurcated extensions of the pivoting member 82 and the eccentric movement of the cam 80 is thus transferred to a rocking movement of the pivoting member 82 about its axle 84. This provides the rocking motion to the arm 24.

The spring 92 serves two purposes. First, as described above, it holds the arms 86 and 88 against the eccentric cam 80 so as to allow transfer of motion of the cam 80 to the arm 24. Secondly it isolates motion from the arm 24 back to the cam 80. Should a child grab one or the other of the ends of the arm 24, the member 82 would pivot about the axle 84, however, motion would not be transferred to the cam 80 because the spring 92 would be stretched as one or the other of the arms 86 or 88 presses against the cam 80. This provides a clutch type mechanism to prevent damage to the working components of the toy 20 should a child grab and move the arm 24.

In reference now to FIGS. 3, 5, 6 and 7, the internal mechanism which causes movement of the members 32, 34 and 36 is shown. On the underside of the disc 78 are first and second cams 94 and 96, respectively. The cam 94 is an arcuate shaped cam which extends around approximately 180 degrees of the underside surface 98 of the disc 78. The cam 96 is somewhat more complex in shape and includes a projection 100 located thereon which is essentially located at the same radial distance from the axle 74 as is the cam 94. The remainder of the cam 96 then curves inwardly in a spiral pattern from the projection 100 towards the center of the disc 78.

The cam 94 is displaced axially along the axis of the axle 74 a particular distance from the underside surface 98 of the disc 78. The projection 100 of cam 96 is displaced a greater axial distance from this same underside surface 98. Thus, between the two cams 94 and 96, a portion of the cam 96, i.e., the projection 100, is located at a greater axial distance from the underside surface 98 than is the cam 94.

A first sliding member 102 which includes the pop up Figure 32 on one end thereof, is located to one side of the disc 78. The sliding member 10 includes two slots collectively identified by the numeral 104, which fit about bosses collectively identified by the numeral 106, which are formed on the plate 77. A spring 108 connects between the end 110 of the sliding member 102 and a small tab formed on the plate 77. This biases the sliding member 102 upwardly such that the pop up Figure 32 is moved to its exposed position. A cover plate 112 is attached to the top of bosses 106 to maintain member 102 positioned thereon.

The end 110 of the sliding member 102 includes a cam follower 114 formed thereon. The cam follower 114 is positioned with respect to the disc 78 such that it contacts both the cam 94 and the projection 100 on the cam 96. As such, both the cam 94 and the cam 96 engage the cam follower 114 and move the sliding member 102 downwardly against the bias of the spring 108. The locus of travel of both the cam 94 and the projection 100 on the cam 96 are such that they will engage the cam follower 114. Since the member 102 is slidably mounted about the bosses 106 it is free to travel in a path which is essentially tangential to the disc 78.

The pop up Figure 32 is exposed out of the housing 22 when the sliding member 102 moves upwardly by the bias of the spring 108 as it relaxes. When in this position, upon clockwise rotation of the disc 78, the end of the cam 94 engages the cam follower 114 on the sliding member 102. As the disc 78 further rotates clockwise, the engagement of the cam follower 114 on the end of the cam 94 slides the sliding member 102 downwardly stretching the spring 198 and withdrawing the pop up Figure 32 into the housing 22. Moving now to FIG. 6, the disc 78 has rotated approximately 60 degrees compared to FIG. 5 and the cam follower 114 has moved off of the end of cam 94 but is engaged against the surface of cam 94. This holds the sliding member 102 downwardly maintaining the pop up Figure 32 within the housing 22. The sliding member 102 will be retained in this position until the disc 78 turns through a sufficient degree of rotation such that the cam 94 is no longer in contact with the cam follower 114. When this happens the member 102 is free to slide upwardly under the influence of the bias of the stretched spring 108.

In the same manner, the cam 96 can engage the cam follower 114 to move the sliding member 102 downwardly. Initially the projection 100 on the cam 96 engages the cam follower 114 to slide the sliding member 102 downward stretching the spring 108. When the projection 100 moves past the cam follower 114 the cam follower 114 rests against the remainder of the cam 96 in the same manner as it did with the cam 94, except the sliding member 102 slowly moves upwardly because of the inward spiral of the arm 96. This allows the pop up Figure 32 to slowly move upwardly. When the cam 96 has completely cleared the cam follower 114 because of further clockwise rotation of the disc 78, the sliding member 102 rapidly slides to its position shown in FIG. 2 under the bias of the spring 108.

The cam 96 likewise engages a second sliding member 116. However, engagement of the cam 96 with the sliding member 116 is only on the projection 100 portion of the cam 96 and not on the remainder of this cam. Further, the cam 94 does not extend sufficiently axially from the underside surface 98 of the disc 78 to engage the cam follower 118 located on the sliding member 116. Thus, while both cams 94 and 96 move the sliding member 102, only the projection portion 100 of cam 96 is capable of engaging and moving the sliding member 116.

Like the sliding member 102, the sliding member 116 has slots collectively identified by the numeral 120, which fit over appropriate bosses collectively identified by the numeral 122 formed on the plate 77. A cover plate 123 maintains the member 116 on the bosses 122. A spring 124 connects between a tab on the plate 77 and an identical tab in the center of the sliding member 116 to bias the sliding member 116 downwardly. This is in opposition to the bias imparted to sliding member 102 which is biased upwardly. Engagement of the projection 100 on the cam 96 against the cam follower 118 moves the sliding member 116 upwardly stretching the spring 124. The movements of the sliding members 102 and 116 are, thus, in opposite directions. Like the sliding member 102, the sliding member 116 moves along a line which is essentially tangent to the disc 78.

The sliding member 116 includes a gear rack 126 which is formed on its outside edge. The spinning disc member 34 is mounted to the housing 22 via an axle 128. The axle 128 also carries a small pinion 130 fixedly mounted thereto. The gear rack 126 engages the pinion 130 to rotate the same in response to upward and downward movement of the sliding member 116. As seen in moving from FIG. 6 to FIG. 7, upward movement of the sliding member 116 causes the pinion 130 and consequently the spinning disc member 34, to rotate counterclockwise. This, of course, is in response to engagement of the projection 100 against the cam follower 118.

After the projection 100 on the cam 96 clears the cam follower 118, the sliding member 116 is free to move downwardly under the bias of the stretched spring 124. As was noted above, it is only the projection 100 which is of sufficient axial displacement from the disc 78 to engage the cam follower 118. Upon downward movement of the sliding member 116, the pinion 130 is rotated clockwise which consequently rotates the spinning indicia member 34 clockwise. On each upward and downward movement of the sliding member 116 upon engagement thereof by the projection 100, the spinning disc member 34 is first rotated in one direction and then is rotated in the opposite direction.

Referring now to FIGS. 2, 8 and 9, the construction of the flip over indicia component 36 is described. The front face 132 of the disc 78 carries a flange 134 on its outer periphery. The flange 134 includes two slots collectively identified by the numeral 136 located 180 degrees apart from each other. A semi-circular plate 138 has axles collectively identified by the numeral 140 projecting outwardly along its flat edge. One of the axles 140 carries a first cam lobe 142 thereon and the other carries a second cam lobe 144 thereon. The cam lobes 142 and 144 are orientated away from each other and each is orientated perpendicular to the plane of plate 138.

Because of the fit of the axles 140 in the slots 136, the plate 138 is free to rotate and overlay first one hemisphere or semi-circular portion of the front surface 132 of the disc 78 and then the other hemisphere or semi-circular portion of the front surface 132 of the disc 78. By painting appropriate indicia on both the back and front of the plate 138 and the two hemispheres of the front surface 132 of the disc 78, two pictures can be displayed by moving the plate 138 first to cover one hemisphere and then to cover the other hemisphere of the front surface 132 of the disc 78.

Rotation of the plate 138 is accomplished as follows. A projecting flange 146 is located on the housing 22 just radially displaced from the flange 134 of the disc 78. As the disc 78 rotates in response to the motor 64, first one of the cam lobes 142 or 144 on the plate 138 will abut against the end of the projection flange 146 to rotate the plate 138 to one side of the disc 78 and after rotation of the disc 78 through 180 degrees, the other of the cam lobes 142 or 144 will contact the edge of the projecting flange 146 to rotate the plate 138 in the opposite way. Thus, in FIG. 8, the plate 138 is covering the left hemisphere of the front surface 132 of the disc 78 and as the disc 78 rotates clockwise, the cam lobe 144 engages the projection flange 146 to cause the plate 138 to rotate as can be seen in FIG. 9, toward a position where it eventually covers the right side hemisphere of the front surface 132 of the disc 78. With each 180 degrees of rotation of the disc 78, the plate 138 is caused to move from one hemisphere to the other.

I claim:

1. A sequential action toy which comprises:

a housing;

motor means located on said housing;

a first cam means rotatably mounted on said housing in operative association with said motor means and rotated about an axis by said motor means;

said first cam means having a surface which is oriented perpendicular to said axis;

said first cam means including first and second cams located thereon and extending axially in the same direction away from said surface, the shape of said first cam different from the shape of said second cam and the axial displacement of said second cam from said surface is greater than the axial displacement of said first cam from said surface;

a first movable member movably mounted on said housing in association with said first cam means, said first movable member including a first cam follower located thereon, said first cam follower positioned in association with said first cam means axially displaced from said surface in a location whereby said first cam follower is independently engagable by both said first and said second cams in response to rotation of said first cam means so as to move said first member on said housing;

a second movable member movably mounted on said housing in association with said first cam means, said second movable member including a second cam follower located thereon, said second cam follower positioned in association with said first cam means axially displaced from said surface in a location whereby said second cam follower is engaged by said second cam in response to rotation of said first cam means so as to move said second member on said housing;

at least a portion of each of said first and said second cams are radially displaced the same distance from said axis;

said first and said second cam followers also being radially displaced the same distance from the axis with the radial displacement of said first and said second cam followers being essentially the same as the radial displacement of said portion of each of said first and said second cams;

said first movable member is slidably mounted on said housing and is positioned tangential to the locus of the pathway of movement of said portions of said first and said second cams.

2. The toy of claim 1 including:

electrical power means located on said housing for supplying electrical power;

switch means located on said housing in electrical association with said power means;

sound producing means located on said housing in electrical association with said switch means;

said sound producing means including microprocessor means, circuit means and speaker means each electrically connected to the other and including said circuit means electrically connected to said switch means;

said motor means electrically associated with said switch means;

said switch means controlling electrical power to both said sound producing means and said motor means.

3. The toy of claim 1 further including:

a further cam means rotatably mounted on said housing in operative association with said motor and rotated by said motor;

said further cam means including a third cam located thereon;

a third movable member movably mounted on said housing in association with said further cam means, said third movable member including a third cam follower located thereon, said third cam follower positioned in association with said further cam means so as to be contacted by said third cam and moved by said third cam in response to rotation of said further cam means so as to move said third movable member on said housing.

4. The toy of claim 3 wherein:

said further cam means is rotated about said same axis as is said first cam means and rotates in conjunction with said first cam means.

5. The toy of claim 3 wherein:

said third cam is eccentrically located on said further cam means so as to eccentrically rotate about said axis.

6. The toy of claim 1 wherein:

said second movable member is slidably mounted on said housing and is positioned tangential to the locus of the pathway of movement of said portions of said first and said second cams.

7. The toy of claim 6 wherein:

said first and said second movable members are positioned on opposite sides of said axis of said first cam means.

8. The toy of claim 7 wherein:

both said first and said second movable members move linearly along pathways which are tangential to said locus of said pathway of movement of said portions of said first and said second cams.

9. The toy of claim 8 wherein:

said first and said second movable members each include biasing means biasing them from a biased to an unbiased position, said first and said second movable members being moved from said unbiased position to said biased position when said first movable member is engaged by said first and said second cams and said second movable member is engaged by said second cam, respectively.

10. The toy of claim 9 wherein:

said first and said second movable members in moving from said unbiased position to said biased position move in opposite directions with respect to one another.

11. The toy of claim 1 further including:

sound producing means located in said housing, said sound producing means produces sound independent of movement of said motor means and any said cam means and movable members associated with said motor means so as to be moved by said motor means.

12. The toy of claim 11 wherein:

said sound producing means includes microprocessor means, circuit means and speaker means each of which being electronically connected to the others.

13. A sequential action toy which comprises:

a housing;

motor means located on said housing;

a first cam means rotatably mounted on said housing in operative association with said motor means and rotated about an axis by said motor means;

said first cam means having a surface which is oriented perpendicular to said axis;

said first cam means including first and second cams located thereon and extending axially from said surface, the axial displacement of said second cam from said surface is greater than the axial displacement of said first cam from said surface;

a first movable member movably mounted on said housing in association with said first cam means, said first movable member including a first cam follower located thereon, said first cam follower positioned in association with said first cam means axially displaced from said furface in a location whereby said first cam follower is independently engagable by both said first and said second cams in response to rotation of said first cam means so as to move said first member on said housing;

a second movable member movably mounted on said housing in association with said first cam means, said second movable member including a second cam follower located thereon, said second cam follower positioned in association with said first cam means axially displaced from said surface in a location whereby said second cam follower is engaged by said second cam in response to rotation of said first cam means so as to move said second member on said housing;

a further cam means rotatably mounted on said housing in operative association with said motor and rotated by said motor;

said further cam means including a third cam located thereon;

a third movable member movably mounted on said housing in association with said further cam means, said third movable member including a third cam follower located thereon, said third cam follower positioned in association with said further cam means so as to be contacted by said third cam and moved by said third cam in response to rotation of said further cam means so as to move said third movable member on said housing;

said third cam is eccentrically located on said further cam means so as to eccentrically rotate about said axis;

said third cam follower comprises a bifurcated member having left and right arms, said left and right arms positioned on opposite sides of said third cam so as to be alternately contacted by said third cam as said third cam eccentrically rotates;

each of said left and right arms are pivotally mounted to said third movable member and further including biasing means connecting between said left and said right arm so as to bias said left and said right arms toward each other and toward said third cam.

14. The toy of claim 13 wherein:

said further cam means is rotated about said same axis as is said first cam means and rotates in conjunction with said first cam means.

15. The toy of claim 14 wherein:

at least a portion of each of said first and said second cams are radially displaced the same distance from said axis;

said first and said second cam followers also being radially displaced the same distance from said axis with the radial displacement of said first and said second cam followers being the same as the radial displacement of said portion of each of said first and said second cams.

16. A sequential action toy which comprises:

a housing;

motor means located on said housing;

a first cam means rotatably mounted on said housing in operative association with said motor means and rotated about an axis by said motor means;

said first cam means having a surface which is oriented perpendicular to said axis;

said first cam means including first and second cams located thereon and extending axially from said surface, the axial displacement of said second cam from said surface is greater than the axial displacement of said first cam from said surface;

a first movable member movably mounted on said housing in association with said first cam means, said first movable member including a first cam follower located thereon, said first cam follower positioned in association with said first cam means axially displaced from said surface in a location whereby said first cam follower is independently engagable by both said first and said second cams in response to rotation of said first cam means so as to move said first member on said housing;

a second movable member movably mounted on said housing in association with said first cam means, said second movable member including a second cam follower located thereon, said second cam follower positioned in association with said first cam means axially displaced from said surface in a location whereby said second cam follower is engaged by said second cam in response to rotation of said first cam means so as to move said second member on said housing;

at least a portion of each of said first and said second cams are radially displaced the same distance from said axis;

said first movable member is slidably mounted on said housing and is positioned tangential to the locus of the pathway of movement of said portions of said first and said second cams;

said first movable member moves linearly along a pathway which is tangential to said locus of the pathway of movement of said portions of said first and said second cams.

17. A sequential action toy which comprises:

a housing;

motor means located on said housing;

a first cam means rotatably mounted on said housing in operative association with said motor means and rotated about an axis by said motor means;

said first cam means having a surface which is oriented perpendicular to said axis;

said first cam means including first and second cams located thereon and extending axially away from said surface, the axial displacement of said second cam from said surface is greater than the axial displacement of said first cam from said surface;

a first movable member movably mounted on said housing in association with said first cam means, said first movable member including a first cam follower located thereon, said first cam follower positioned in asociation with said first cam means axially displaced from said surface in a location whereby said first cam follower is independently engagable by both said first and said second cams in response to rotation of said first cam means so as to move said first member on said housing;

a second movable member movably mounted on said housing in association with said first cam means, said second movable member including a second cam follower located thereon, said second cam follower positioned in association with said first cam means axially displaced from said surface in a location whereby said second cam follower is engaged by said second cam in response to rotation of said first cam means so as to move said second member on said housing;

said first cam means includes a second surface, said second surface located on said first cam means adjacent to said housing;

a pivot member pivotally associated with said second surface to move between a first orientation with respect to said second surface and a second orientation with respect to said second surface, said pivoting member overlaying a first portion of said second surface when in said first orientation and overlaying a second portion of said surface when in said second orientation;

pivot member moving means for moving said pivot member between said first and said second orientations, a first section of said pivot member moving means located on said pivot member and a second section of said pivot member moving means located on said housing, said first section of said pivot member moving means engaging said second section of said pivot member moving means as said first cam means rotates, the engagement of said first section of said pivot member moving means with said second section of said pivot member moving means alternately moving said pivot member between said first and said second orientations.

18. The toy of claim 17 wherein:

said first section of said pivot member moving means comprises at least one pivot member cam attaching to said pivot member;

said second section of said pivot member moving means comprises a contact surface located on said housing adjacent to said second surface of said first cam means, said pivot cam contacting and engaging said contact surface as said first cam means rotates so as to move said pivot member.

19. The toy of claim 18 wherein:

said second surface of said first cam means comprises a circular surface;

said pivot member having a semi-circular shape so as to overlay first a first semi-circular portion of said circular surface in said first orientation and a second semi-circular portion of said circular surface in said second orientation.

20. The toy of claim 19 including:

two pivot cams located on opposite sides of said semi-circular pivot member along a diameter of said circular second surface;

one of said pivot cams engaging said engaging surface to move said pivot member from said first orientation to said second orientation as said first cam means rotates and a second of said pivot cams engaging said engagement member to move said pivot member from said second orientation back to said first orientation as said first cam means rotates.

* * * * *